US007718886B1

(12) United States Patent
Lace

(10) Patent No.: US 7,718,886 B1
(45) Date of Patent: May 18, 2010

(54) SENSOR ASSEMBLY FOR STRINGED MUSICAL INSTRUMENTS

(75) Inventor: Jeffrey J. Lace, Huntington Beach, CA (US)

(73) Assignee: Actodyne General, Inc., Huntington Beach, CA (US)

( * ) Notice: Subject to any disclaimer, the term of this patent is extended or adjusted under 35 U.S.C. 154(b) by 737 days.

(21) Appl. No.: 10/887,994

(22) Filed: Jul. 9, 2004

Related U.S. Application Data

(63) Continuation-in-part of application No. 10/053,440, filed on Jan. 18, 2002, now Pat. No. 6,897,369.

(60) Provisional application No. 60/488,128, filed on Jul. 17, 2003.

(51) Int. Cl.
*G10H 3/14* (2006.01)

(52) U.S. Cl. ..... 84/727

(58) Field of Classification Search ..... 84/726–728
See application file for complete search history.

(56) References Cited

U.S. PATENT DOCUMENTS

| | | | | |
|---|---|---|---|---|
| 2,581,653 | A | 1/1952 | Grimshaw | |
| 3,992,972 | A | 11/1976 | Rickard | |
| 4,010,334 | A | 3/1977 | Demeter | |
| 4,050,341 | A | 9/1977 | Underwood | |
| 4,096,780 | A | 6/1978 | Dawson | |
| 4,145,944 | A | 3/1979 | Helpinstill, II | |
| 4,184,399 | A | 1/1980 | Zuniga | |
| 4,188,849 | A | 2/1980 | Rickard | |
| 4,261,240 | A | 4/1981 | Aaroe | |
| 4,269,103 | A | 5/1981 | Underwood | |
| 4,319,510 | A * | 3/1982 | Fender | 84/728 |
| 4,364,295 | A | 12/1982 | Stich | |
| 4,378,722 | A | 4/1983 | Isakson | |
| 4,499,809 | A | 2/1985 | Clevinger | |
| 4,545,278 | A | 10/1985 | Gagon et al. | |
| 4,581,974 | A | 4/1986 | Fender | |
| 4,581,975 | A | 4/1986 | Fender | |
| 4,809,578 | A | 3/1989 | Lace, Jr. | |
| 4,869,144 | A | 9/1989 | Lieber | |
| 4,872,386 | A | 10/1989 | Betticare | |
| 4,885,970 | A | 12/1989 | Fender | |
| 4,911,054 | A | 3/1990 | McClish | |
| 4,913,024 | A * | 4/1990 | Carriveau | 84/726 |
| 4,941,389 | A | 7/1990 | Wendler | |
| 5,027,691 | A | 7/1991 | Kennedy | |
| 5,111,728 | A | 5/1992 | Blucher et al. | |
| 5,168,117 | A | 12/1992 | Anderson | |
| 5,189,241 | A | 2/1993 | Nakamura | |
| 5,200,569 | A | 4/1993 | Moore | |

(Continued)

*Primary Examiner*—Jeffrey Donels
(74) *Attorney, Agent, or Firm*—Bliss McGlynn, P.C.

(57) ABSTRACT

A sensor assembly for a stringed musical instrument having a plurality of movable strings includes a primary winding adapted to be disposed at one end of either one of a fingerboard and a neck of the stringed musical instrument. The sensor assembly includes at least one magnet disposed adjacent the primary winding and the movable strings to generate a magnetic field. The primary winding creates a primary current from a disruption in the magnetic field by the movable strings and the primary current creates a primary electromagnetic flux. The sensor assembly further includes at least one secondary being coupled to the primary winding. The at least one secondary winding transforms the primary electromagnetic flux into a secondary current adapted to pass out the stringed musical instrument.

25 Claims, 8 Drawing Sheets

U.S. PATENT DOCUMENTS

| | | | | | |
|---|---|---|---|---|---|
| 5,252,777 | A | | 10/1993 | Allen | |
| 5,290,968 | A | | 3/1994 | Mirigliano et al. | |
| 5,292,998 | A | | 3/1994 | Knapp | |
| 5,292,999 | A | | 3/1994 | Tumura | |
| 5,311,806 | A | | 5/1994 | Riboloff | |
| 5,321,201 | A | * | 6/1994 | Noreen | 84/735 |
| 5,376,754 | A | | 12/1994 | Stich | |
| 5,389,731 | A | | 2/1995 | Lace | |
| 5,391,831 | A | | 2/1995 | Lace | |
| 5,391,832 | A | | 2/1995 | Lace | |
| 5,399,802 | A | | 3/1995 | Blucher | |
| 5,401,900 | A | | 3/1995 | Lace | |
| 5,408,043 | A | | 4/1995 | Lace | |
| 5,422,432 | A | | 6/1995 | Lace | |
| 5,430,246 | A | | 7/1995 | Lace, Sr. et al. | |
| 5,438,158 | A | | 8/1995 | Riboloff | |
| 5,464,948 | A | | 11/1995 | Lace | |
| 5,484,958 | A | | 1/1996 | Ogawa | |
| 5,525,750 | A | | 6/1996 | Beller | |
| 5,610,357 | A | | 3/1997 | Frank-Braun | |
| 5,641,932 | A | | 6/1997 | Lace | |
| 5,767,431 | A | * | 6/1998 | Khanagov | 84/726 |
| 5,792,973 | A | * | 8/1998 | Riboloff | 84/726 |
| 5,811,710 | A | | 9/1998 | Blucher et al. | |
| 5,831,196 | A | | 11/1998 | Khanagov | |
| 6,051,765 | A | | 4/2000 | Regenberg et al. | |
| 6,111,185 | A | | 8/2000 | Lace | |
| 6,121,537 | A | * | 9/2000 | Pawar et al. | 84/728 |
| 6,441,293 | B1 | * | 8/2002 | LaBarbera | 84/723 |
| 6,627,808 | B1 | | 9/2003 | Coats et al. | |
| 7,244,886 | B2 | * | 7/2007 | Hosler | 84/726 |
| 2003/0145715 | A1 | * | 8/2003 | Wnorowski | 84/726 |

* cited by examiner

FIG 1
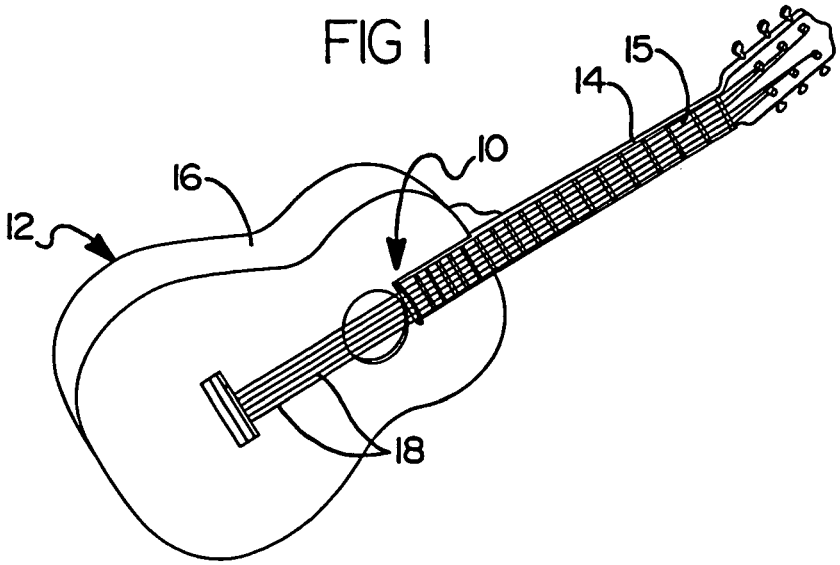
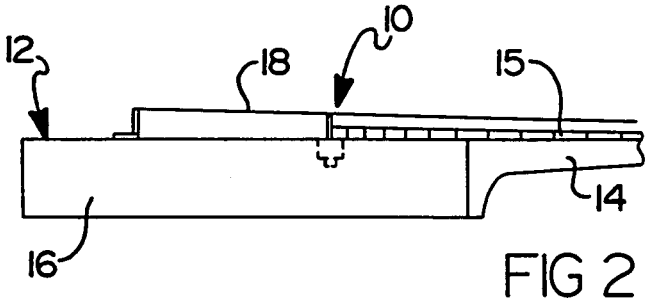
FIG 2
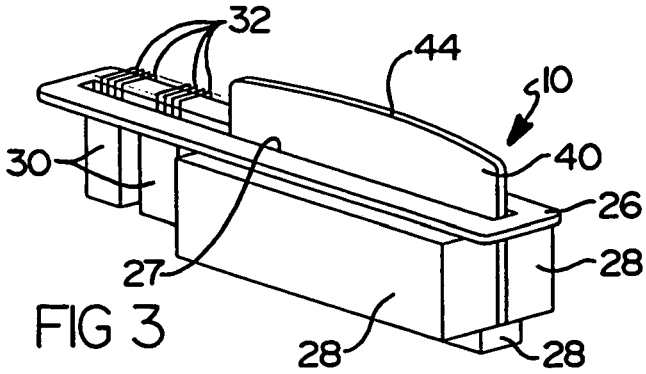
FIG 3
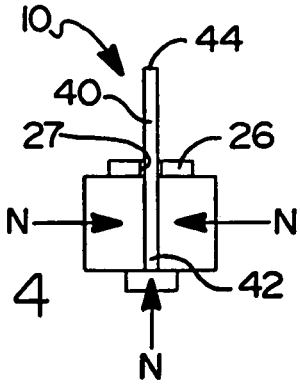
FIG 4

FIG 5
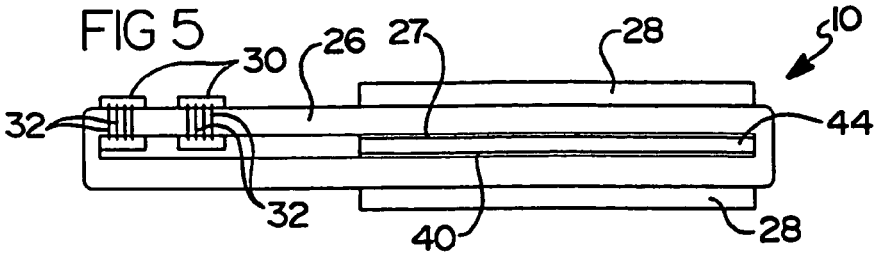
FIG 6
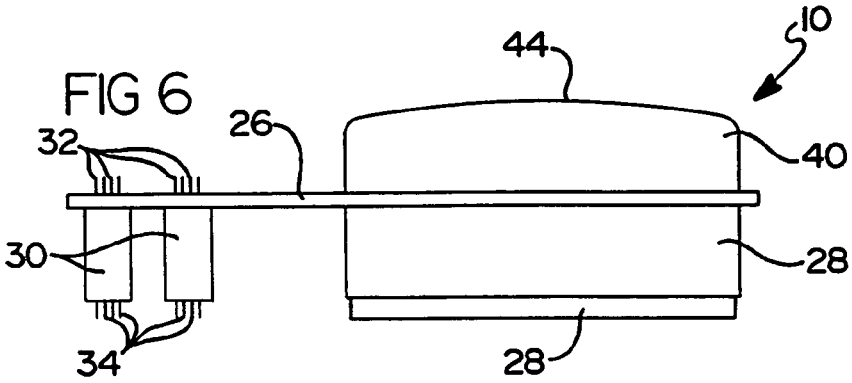
FIG 7
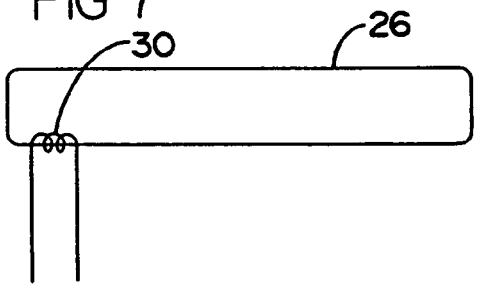
FIG 8
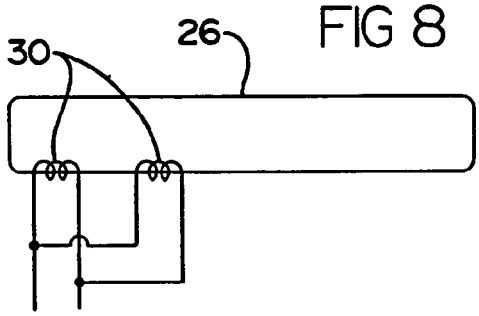
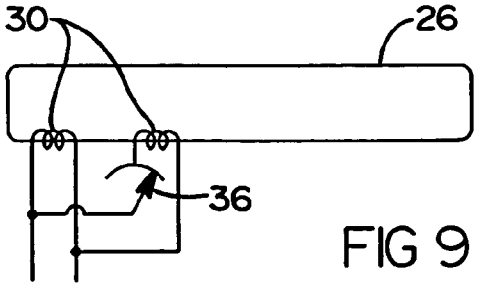
FIG 9

FIG 10
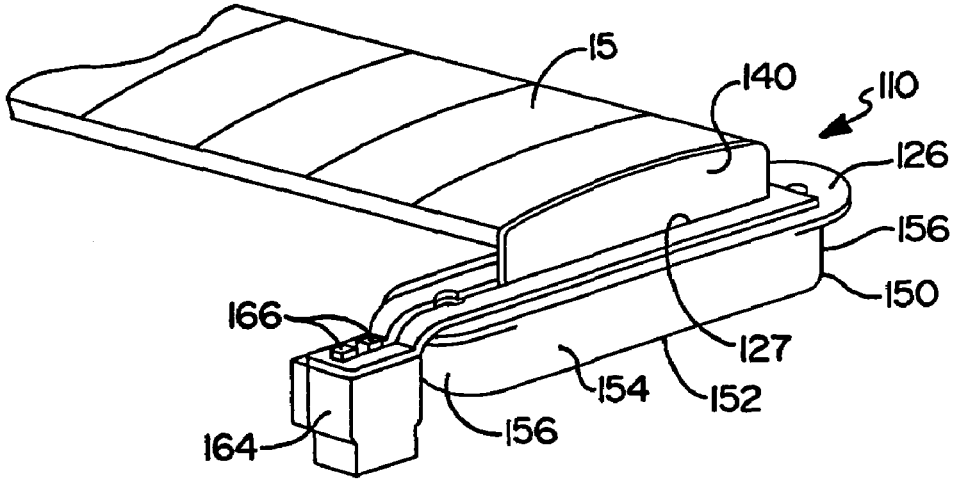
FIG 11
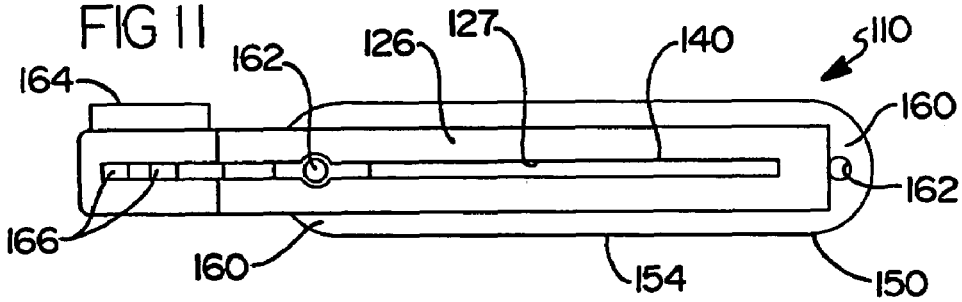
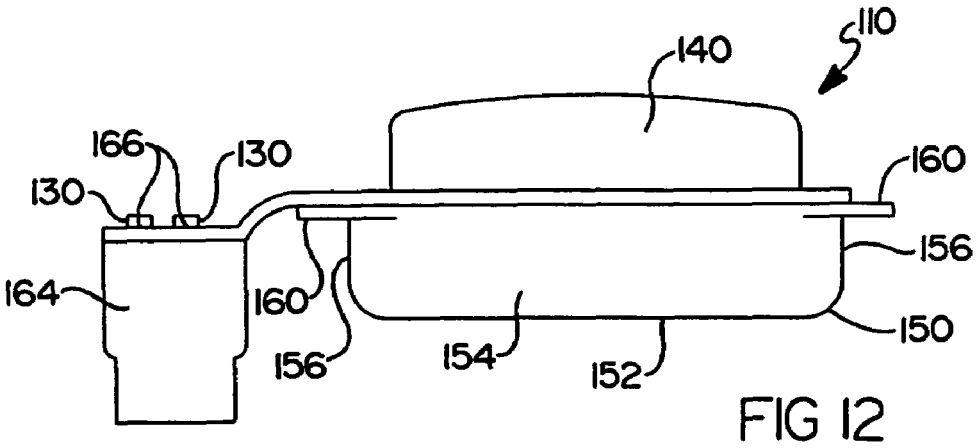
FIG 12

FIG 15
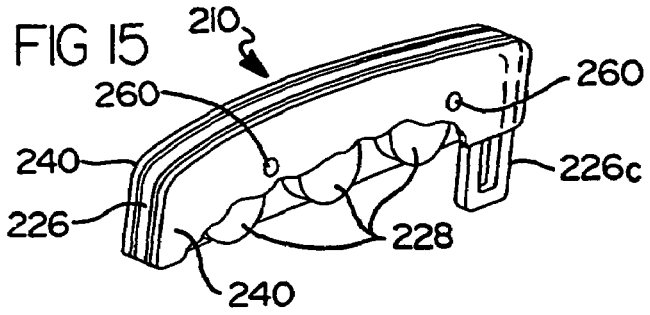
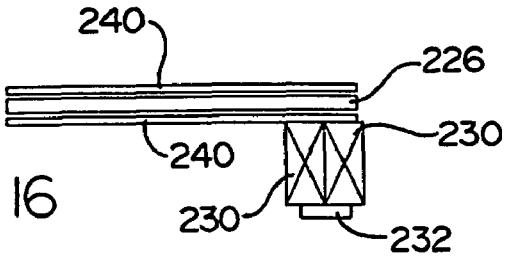
FIG 16
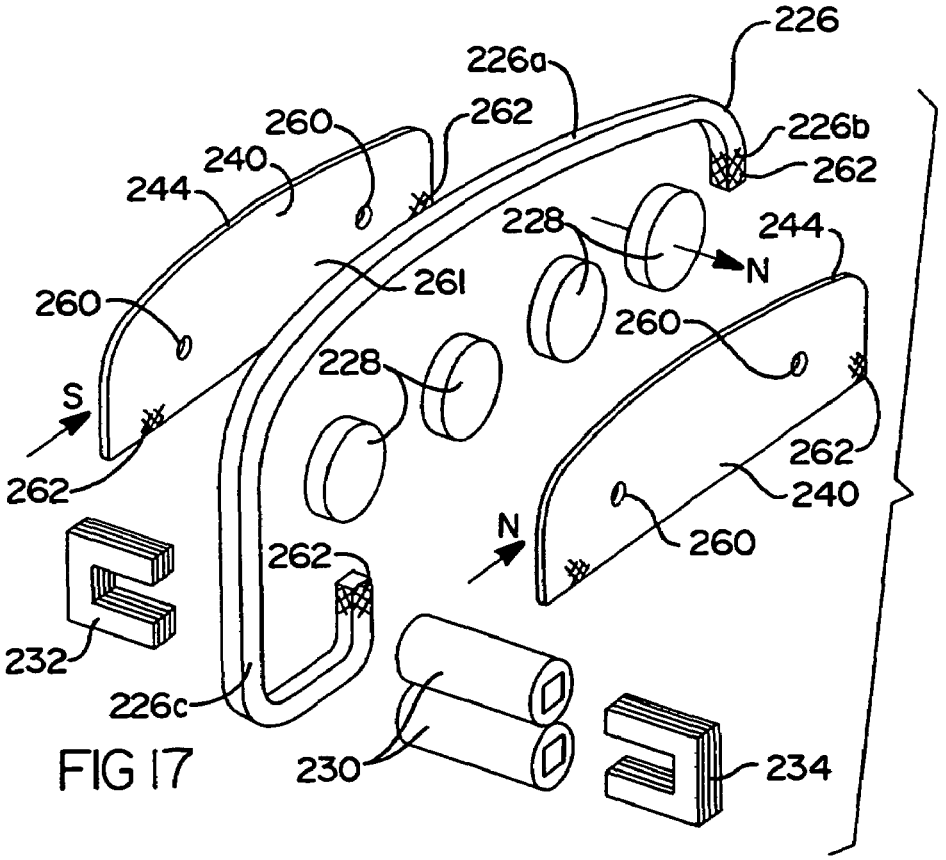
FIG 17

SENSOR ASSEMBLY FOR STRINGED MUSICAL INSTRUMENTS

CROSS-REFERENCE TO RELATED APPLICATIONS

The present application is a continuation-in-part application of U.S. patent application Ser. No. 10/053,440, filed Jan. 18, 2002 now U.S. Pat. No. 6,897,369 and entitled "Sensor Assembly for Stringed Musical Instruments," and claims the benefit of U.S. Provisional Patent Application Ser. No. 60/488,128, filed Jul. 17, 2003 and entitled "Sensor Assembly for Stringed Musical Instruments."

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy, to produce music and the like.

U.S. Pat. Nos. 5,501,900 and 5,438,157, issued to Lace, disclose an acoustic electromagnetic sensor assembly and mounting assembly for a stringed musical instrument. In these patents, the sensor assembly has a mounting assembly that fits in a sound hole of the stringed musical instrument. These electromagnetic sensors have a high visual impact when mounted on a stringed musical instrument such as an acoustic guitar. Further, these electromagnetic sensors typically have a tone and output that has a single value.

It is desirable to provide a sensor assembly that has less of a visual impact. It is also desirable to provide a sensor assembly with more variations in tone and output. Therefore, there is a need in the art to provide a sensor assembly, which meets these desires.

SUMMARY OF THE INVENTION

It is, therefore, one object of the present invention to provide a sensor assembly for a stringed musical instrument.

It is another object of the present invention to provide an electromagnetic sensor for an acoustic stringed musical instrument that has a low visual impact.

It is a further object of the present invention to provide an electromagnetic sensor for an acoustic stringed musical instrument that provides flexibility in tone and output of the sensor.

To achieve the foregoing objects, the present invention is a sensor assembly for a stringed musical instrument having a plurality of movable strings. The sensor assembly includes a primary winding adapted to be disposed at one end of either one of a fingerboard and a neck of the stringed musical instrument. The sensor assembly includes at least one magnet disposed adjacent the primary winding and the movable strings to generate a magnetic field. The primary winding creates a primary current from a disruption in the magnetic field by the movable strings and the primary current creates a primary electromagnetic flux. The sensor assembly further includes at least one secondary being coupled to the primary winding. The at least one secondary winding transforms the primary electromagnetic flux into a secondary current adapted to pass out the stringed musical instrument.

One advantage of the present invention is that a new sensor assembly is provided for a stringed musical instrument. Another advantage of the present invention is that a sensor assembly is provided for a stringed musical instrument, which has low impact visually on the instrument or is completely invisible on the instrument. A further advantage of the present invention is that the sensor assembly provides flexibility in the tone and output of the sensor. Yet a further advantage of the present invention is that the sensor assembly is quieter via making a primary winding humbucking. Still a further advantage of the present invention is that the sensor assembly uses neodymium magnets to decrease the packaging size, making the assembly smaller, and more versatile in mounting. Another advantage of the present invention is that the sensor assembly aesthetically blends into the neck or fingerboard of the stringed musical instrument such as a guitar. Yet another advantage of the present invention is that the sensor assembly has full humbucking primary and secondary windings. Still another advantage of the present invention is that the sensor assembly has greater sensitivity with a primary winding at the top of the blade. A further advantage of the present invention is that the sensor assembly is non-visually distracting and blends in with the end of the neck or fingerboard or can be in the neck or fingerboard.

Another advantage of the present invention is that the sensor assembly has quiet operation and strong passive output. Yet another advantage of the present invention is that the sensor assembly combines a magnetic pickup with a polymer film/piezo bridge pickup on an acoustic guitar. Still another advantage of the present invention is that the sensor assembly is substantially completely passive and has loud passive more accurate acoustic reproduction. A further advantage of the present invention is that the sensor assembly has high feedback rejection. Yet a further advantage of the present invention is that the sensor assembly has a passive operation. Still a further advantage of the present invention is that the sensor assembly is available as an OEM factory installation or aftermarket installation.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a sensor assembly, according to the present invention, illustrated in operational relationship with a stringed musical instrument.

FIG. 2 is a side elevational view of the sensor assembly and stringed musical instrument of FIG. 1.

FIG. 3 is a perspective view of the sensor assembly of FIG. 1.

FIG. 4 is a side elevational view of the sensor assembly of FIG. 1.

FIG. 5 is a plan view of the sensor assembly of FIG. 1.

FIG. 6 is a front view of the sensor assembly of FIG. 1.

FIG. 7 is a schematic view of a single secondary winding for the sensor assembly of FIG. 1.

FIG. 8 is a schematic view of a dual secondary winding in parallel for the sensor assembly of FIG. 1.

FIG. 9 is a schematic view of a dual secondary winding with a potentiometer for the sensor assembly of FIG. 1.

FIG. 10 is a perspective view of another embodiment, according to the present invention, of the sensor assembly of FIG. 1 illustrated in operational relationship with a stringed musical instrument.

FIG. 11 is a plan view of the sensor assembly of FIG. 10.

FIG. 12 is a front view of the sensor assembly of FIG. 10.

FIG. 15 is a perspective view of the sensor assembly of FIG. 13 illustrated with the secondary windings removed.

FIG. 16 is a plan view of the sensor assembly of FIG. 13.

FIG. 17 is an exploded perspective view of the sensor assembly of FIG. 13.

DESCRIPTION OF THE PREFERRED EMBODIMENT(S)

Figure 13:
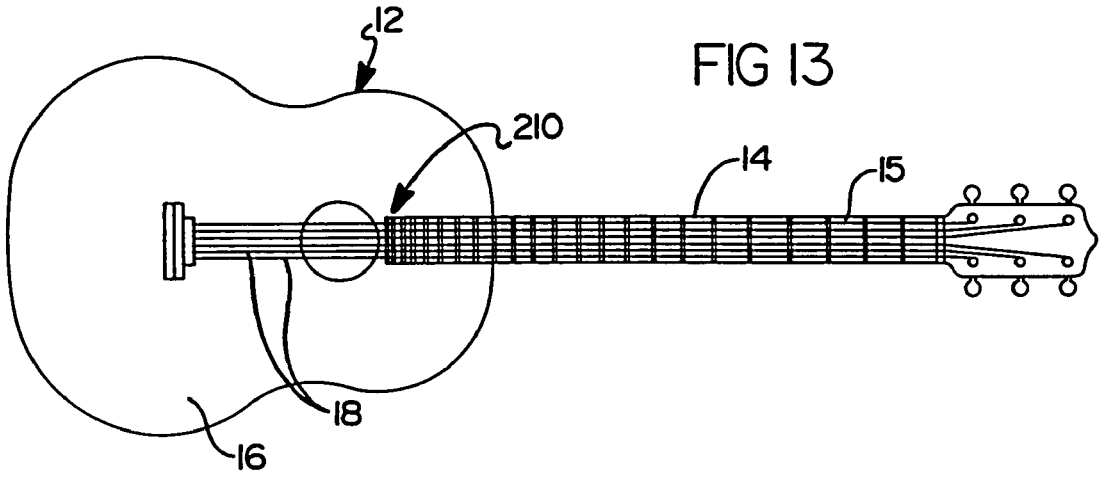
FIG. 13 is a plan view of yet another embodiment, according to the present invention, of the sensor assembly of FIG. 1 illustrated in operational relationship with a stringed musical instrument.

Referring to the drawings and, in particular, to FIGS. 1 and 2, one embodiment of a sensor assembly 10, according to the present invention, is illustrated in operational relationship with a stringed musical instrument, such as a guitar, generally indicated at 12. The guitar 12 is of the acoustical type having a neck portion 14 with a fingerboard 15, a body portion 16, and a plurality of strings extending along the neck and body portions 14 and 16, respectively. The sensor assembly 10 is disposed beneath the strings 18 and mounted to the body portion 16 adjacent to or in the fingerboard 15 in a manner to be described. Although the sensor assembly 10 is illustrated with a guitar 12, it should be appreciated that any suitable type of stringed musical instrument may be enhanced by the sensor assembly 10. It should further be appreciated that the sensor assembly 10 may be used with an electric type of stringed musical instrument 12.

The sensor assembly 10 may include a case (not shown) extending longitudinally and having a general "U" shape cross-section. The case has a generally planar base wall and a pair of generally planar side walls substantially parallel to each other and connected by generally arcuate shaped corner walls to the base wall to form a longitudinal channel. Preferably, the longitudinal channel has a lateral width greater than a height thereof. The case is fabricated from a single piece of ferromagnetic material such as an iron-based steel. The case may be secured by suitable means such as fasteners (not shown) to the fingerboard 15 as illustrated in FIG. 2.

Referring to FIGS. 2 through 6, the sensor assembly 10 includes a primary winding 26 made from a conductive material. Preferably, the primary winding 26 is made of a conductive material such as copper. The primary winding 26 is preferably a solid piece of copper made as a single layer stamping or multilaminate construction. It should be appreciated that the primary winding 26 may be made of any suitable conductive material.

The primary winding 26 has a configuration that acts as a one-turn receiver. In one embodiment, the primary winding 26 has a generally rectangular shape with a slot 27 extending therethrough. The primary winding 26 has a predetermined length. Preferably, the primary winding 26 extends to encompass all of the moveable strings 18. It should be appreciated that the primary winding 26 may be configured to have other suitable shapes other than the rectangular shape. It should also be appreciated that the primary winding 26 may be a plurality of windings.

The sensor assembly 10 also includes at least one, preferably a plurality of magnets 28 disposed adjacent the primary winding 26 to provide a magnetic flux field to the strings 18. The magnets 28 are secured to the interior surface of the case by suitable means such as an adhesive bonding agent. The magnets 28 are a permanent magnet strip and is made of a flexible permanent magnet material such as PLASTIFORM° which is commercially available from Arnold Engineering, Marango, Ill. The magnets 28 extend longitudinally and are generally rectangular in shape. It should be appreciated that the magnets 28 are orientated in a manner to be described.

The sensor assembly 10 also includes at least one, preferably a plurality of secondary windings 30 adjacent to the primary winding 26. In one embodiment, the secondary windings 30 extend generally perpendicular to the primary winding 26. The secondary windings 30 are coils of a conductive wire such as copper wrapped around core elements 32,34 to be described. It should be appreciated that the secondary windings 30 can be either single or multiple coils connected in series or parallel.

The secondary windings 30 are susceptible to electromagnetic flux transferred by the core elements 32 to be described from the primary winding 26. The secondary windings. 30 transform the primary electromagnetic flux into a secondary current. More specifically, the primary winding 26 and the secondary windings 30 and the core elements 32,34 act together as a transformer which transforms the primary current into the secondary current. The secondary current is passed through an output port (not shown) to electronics subsequent to the sensor assembly 10. Although the primary winding 26 is shown to be a separate circuit than that of the secondary windings 30, the secondary windings 30 may in an alternative embodiment (not shown) be connected in series to the primary winding 26 at a common point to create an autotransformer. It should be appreciated that possible electronic components, which may be operatively connected to the output port include receivers, synthesizers, amplifiers, speakers, and the like.

The secondary windings 30 are shorter in length than the predetermined length of the primary winding 26. The secondary windings 30 include a first core element 32, which extends through one end of the secondary windings 30 and a second core element 34, which extends through the other end of the secondary windings 30. In one embodiment, the first and second core elements 32,34, which are "U" shaped in appearance, extend into the secondary windings 30 from each end and telescopingly engage. The core elements 32,34 are made from laminations of a high permeable magnetic material such as steel. It should be appreciated that the sensor assembly 10 may have a single secondary winding 30 as illustrated in FIG. 7 or multiple secondary windings 30 as illustrated in FIGS. 3 through 6 that can be combined in different ways to create a variety of tones. It should also be appreciated that the multiple secondary windings 30 may be configured in a dual parallel arrangement as illustrated in FIG. 8 or with a potentiometer 36 as illustrated in FIG. 9. It should further be appreciated that the use of multiple secondary windings 30 provides flexibility in the tone and output of the sensor assembly 10. It should be still further appreciated that the multiple secondary windings 30 can be a variety of values and can be used with an elongated primary winding 26 to allow flexibility in the design and placement of the sensor assembly 10.

The sensor assembly 10 further includes a blade 40 extending through the slot 27 in the primary winding 26. The blade 40 acts as a core piece to conduct the magnetic field and to provide a flux connection to the strings 18. The blade 40 is fabricated from a ferromagnetic material such as cold rolled steel. The blade 40 is a thin plate made of steel or other such material that is susceptible to a magnetic field. The blade 40 includes a base end 42 and a distal end 44. The base end 42 is disposed adjacent the magnets 28 and may be fixedly secured to the magnets 28 via any suitable securing device, such as an adhesive epoxy. The distal end 44 is a sharp edge, which receives the movable strings 18 thereon. The distal end 44 is curvilinear allowing it to blend in with the curvature of the fingerboard 15 and apply equal flux on each of the movable strings 18 so that each of the movable strings 18 affects the magnetic field from the blade 40 equally. It should be appreciated that the curvilinear shape of the distal end 44 might vary depending on the type of stringed musical instrument 12 used. It should also be appreciated by that the distal end 44 may even be straight for such instruments as acoustic violins, banjos, ukuleles, and the like wherein the strings all are set in a single plane.

Referring to FIGS. 10 through 12, another embodiment, according to the present invention, of the sensor assembly 10 is shown. Like parts of the sensor assembly 10 have like reference numerals increased by one hundred (100). In this embodiment, the sensor assembly 110 includes a case or cover 150 extending longitudinally and having a general "U" shape cross-section. The cover 150 has a generally planar base wall 152 and a pair of generally planar side walls 154 substantially parallel to each other and connected by generally arcuate shaped corner walls 156 to the base wall to form a longitudinal channel 158. Preferably, the longitudinal channel 158 has a lateral width greater than a height thereof. The cover 150 has a flange 160 extending outwardly at each corner wall 156 and generally perpendicular thereto. The flange 160 has an aperture 162 extending therethrough to allow a fastener (not shown) to extend through the aperture 162 and slot 127 of the primary winding 126 and secure the cover 150 to the body portion 16 of the stringed musical instrument 12. The cover 150 is fabricated from a single piece of material such as plastic or an iron based steel and forms a cup to contain the magnets 128, primary winding 126, and blade 140.

The sensor assembly 110 also has a case 164 for the secondary windings 130. The case 164 is disposed about the secondary windings 130 and secured thereto by suitable means. The core piece 132 may have a projection 166 to extend through the slot 127 to secure the secondary winding 130 to the primary winding 126. It should also be appreciated that the primary winding 126 may have a portion disposed below a plane of a remainder thereof to which the secondary windings 130 are attached.

Referring to FIGS. 13 through 17, yet another embodiment, according to the present invention, of the sensor assembly 10 is shown. Like parts of the sensor assembly 10 have like reference numerals increased by two hundred (200). In this embodiment, the sensor assembly 210 includes a primary winding 226 having a configuration that acts as a one-turn receiver. In this embodiment, the primary winding 226 has a base **226*a* extending transversely to encompass all of the moveable strings 18. The primary winding 226 also has a first end 226*b* extending generally perpendicular to the base 226*a* and a second end 226*c* extending generally perpendicular to the base 226*a*. The second end 226*c* has a generally "J" shape for a function to be described. The primary winding 226 is made from a non-ferrous, conductive material. Preferably, the primary winding 226 is made of a conductive material such as copper. It should be appreciated that the first end 226*b* and second end 226*c* do not contact each other and that the primary winding 226** is not a closed loop, but an open loop.

The sensor assembly 210 also includes at least one, preferably a plurality of magnets 228 disposed adjacent the primary winding 226 to provide a magnetic flux field to the strings 18. The magnets 228 are secured between and to a pair of blades 240 to be described by suitable means such as an adhesive bonding agent. The magnets 228 are made of a permanent magnet material such as Neodymium, which is commercially available. The magnets 228 are spaced longitudinally and are generally circular in shape. It should be appreciated that the magnets 228 are orientated in a manner to be described. It should also be appreciated that the magnets 228 may be made of other types of magnetic material.

The sensor assembly 210 also includes at least one, preferably a plurality of secondary windings 230 adjacent to the primary winding 226. In one embodiment, the secondary windings 230 extend generally perpendicular to the primary winding 226. The secondary windings 230 are coils of a conductive wire such as copper wrapped around core elements 232,234.

The secondary windings 230 are susceptible to electromagnetic flux transferred by the core elements 232 from the primary winding 226. The secondary windings 230 transform the primary electromagnetic flux into a secondary current. More specifically, the primary winding 226 and the secondary windings 230 and the core elements 232,234 act together as a transformer which transforms the primary current into the secondary current. The secondary current is passed through an output port (not shown) to electronics subsequent to the sensor assembly 210. It should be appreciated that possible electronic components, which may be operatively connected to the output port include receivers, synthesizers, amplifiers, speakers, and the like.

Figure 14:
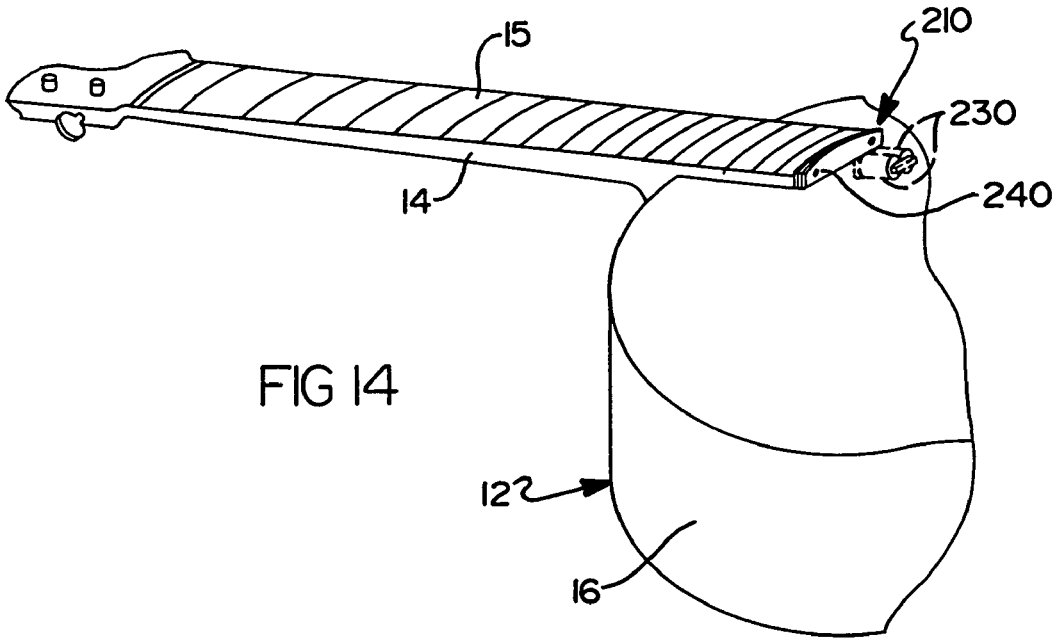
FIG. 14 is a partial perspective view of the sensor assembly and stringed musical instrument of FIG. 13 illustrated with the strings removed.

The secondary windings 230 are shorter in length than the predetermined length of the primary winding 226. The secondary windings 230 include a first core element 232, which extends through one end of the secondary windings 230 and a second core element 234, which extends through the other end of the secondary windings 230. In one embodiment, the first and second core elements 232,234, which are "U" shaped in appearance, extend into the secondary windings 230 from each end and telescopingly engage. Each of the core elements 232,234 is made from a plurality of laminations, preferably four, of a high permeable magnetic material such as steel. It should be appreciated that the sensor assembly 210 has a pair of secondary windings 230 that act as dual humbucking secondaries. It should also be appreciated that the secondary windings 230 may be spaced farther from the primary winding 226 as illustrated in FIG. 14.

The sensor assembly 210 further includes a plurality, preferably a pair, of blades 240 disposed on the sides of the primary winding 226 such that the primary winding 226 is disposed therebetween. The blades 240 act as a core piece to conduct the magnetic field and to provide a flux connection to the strings 18. The blades 240 are fabricated from a ferromagnetic material such as cold rolled steel. The blades 240 are a thin plate made of steel or other such material that is susceptible to a magnetic field. The blade 240 includes at least one, preferably a plurality of apertures 260 extending therethrough for a function to be described. One of the blades 240 is disposed adjacent the magnets 228 and the blade 240 may be fixedly secured to the magnets 228 via any suitable securing device, such as an adhesive epoxy. The other one of the blades 240 has an inner surface 261 that is electrically insulated from the magnets 228. That blade 240 disposed on one side of the primary winding 226 and the other blade 240 is disposed on the other side of the primary winding 226 and the primary winding 226 and blades 240 are electrically secured together by suitable means such as soldering at a plurality of locations 262. The blades 240 have a distal end 244 that is curvilinear allowing it to blend in with the curvature of the fingerboard 15 and apply equal flux on each of the movable strings 18 so that each of the movable strings 18 affects the magnetic field from the blades 240 equally. It should be appreciated that the curvilinear shape of the distal end 244 might vary depending on the type of stringed musical instrument 12 used. It should also be appreciated by that the distal end 244 may even be straight for such instruments as acoustic violins, banjos, ukuleles, and the like wherein the strings 18 all are set in a single plane. It should further be appreciated that one of the blades 240 is magnetic north and the other blade 240 is magnetic south. It should still further be appreciated that the sensor assembly 210 may be mounted to the end of the neck 14 by suitable means such as fasteners (not shown) extending through the apertures 260 in the blades 240 and into the neck 14.

Figure 18:
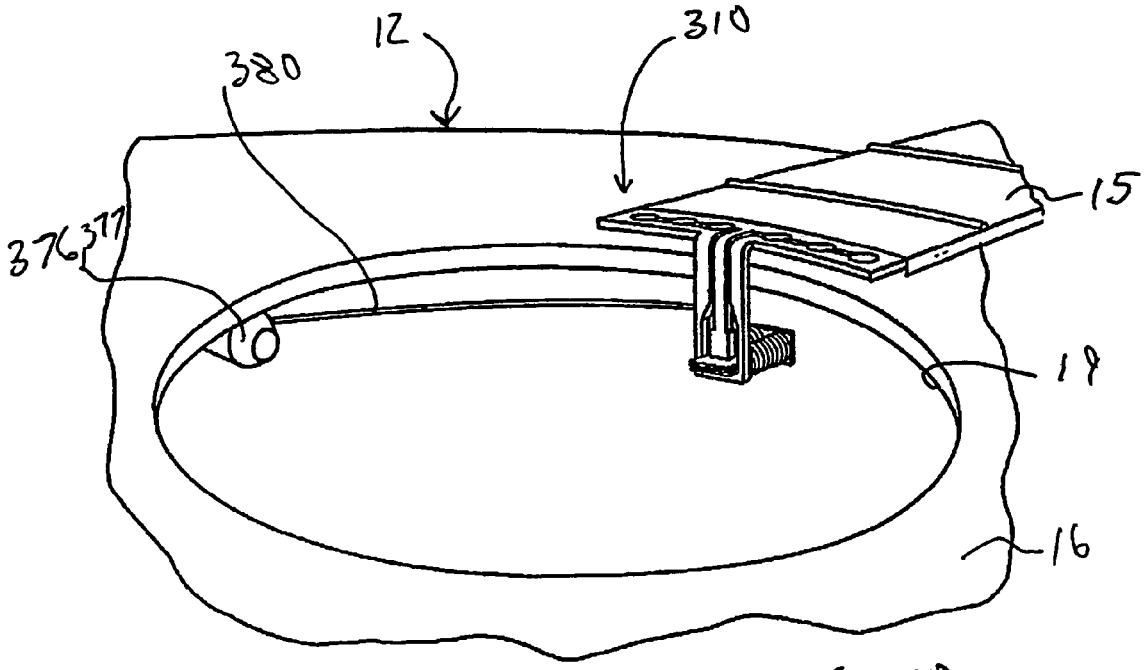
FIG. 18 is a perspective view of still another embodiment, according to the present invention, of the sensor assembly of FIG. 1 illustrated in operational relationship with a portion of a stringed musical instrument with the strings removed.
Figure 19:
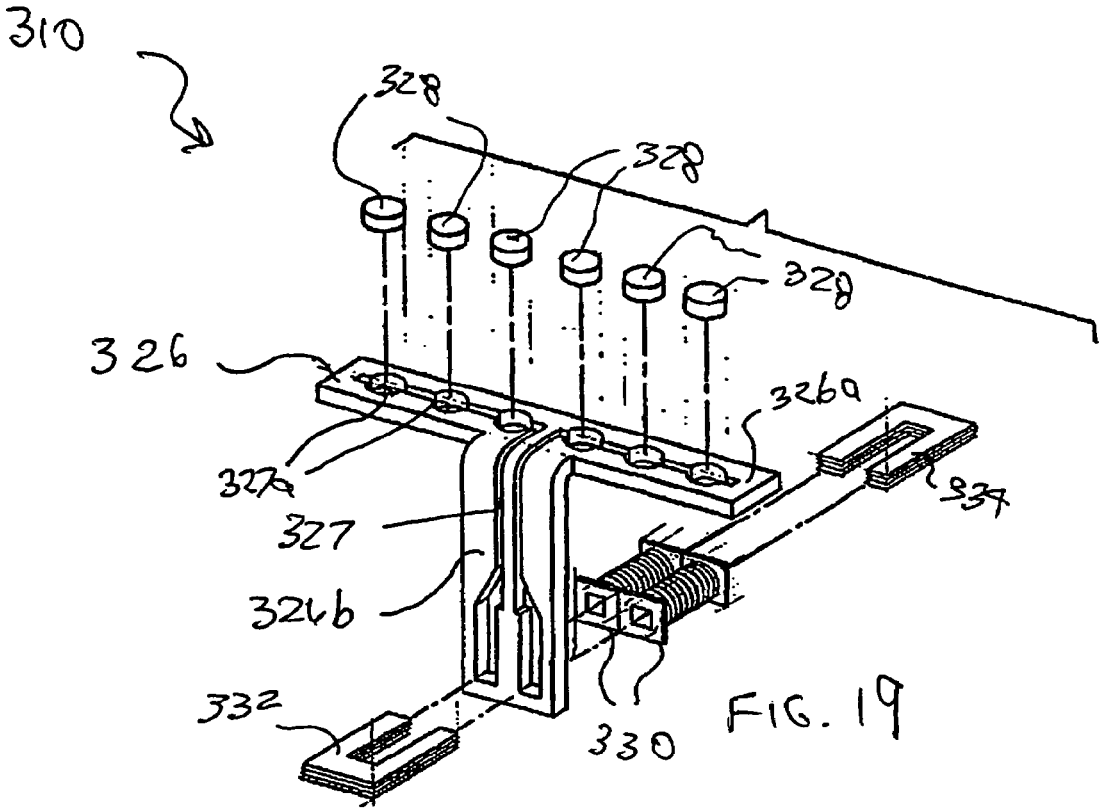
FIG. 19 is an exploded perspective view of the sensor assembly of FIG. 18.
Figure 20:
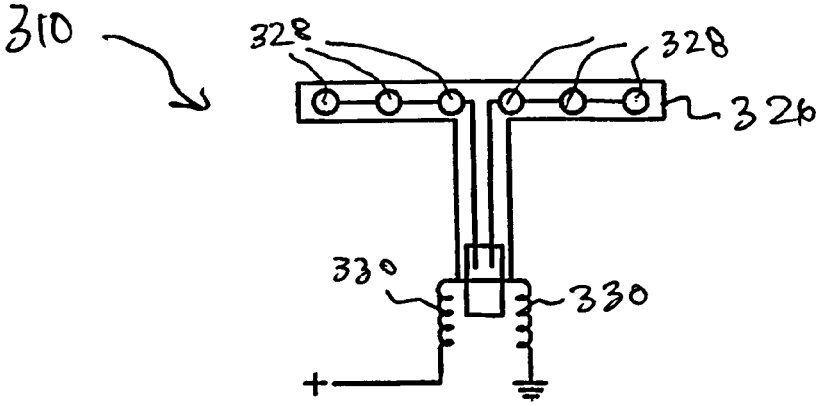
FIG. 20 is a schematic view of the sensor assembly of FIG. 18.

Referring to FIGS. 18 through 20, still another embodiment, according to the present invention, of the sensor assembly 10 is shown. Like parts of the sensor assembly 10 have like reference numerals increased by three hundred (300). In this embodiment, the sensor assembly 310 is mounted at the end of the fingerboard 15 proximate to the body portion 16. The sensor assembly 310 can be attached to the fingerboard 15 or body portion 16 by suitable means such as adhesive tape or adjustable screw mounts (not shown).

The sensor assembly 310 includes a primary winding 326 having a generally "T" shape. More specifically, the primary winding 326 has a base 326*a* extending laterally to encompass all of the moveable strings 18 and having a function to be described. The base 326*a* has at least one slot 327 extending therethrough and a plurality of generally circular apertures 327*a* spaced substantially equidistantly along the base 326*a* for a function to be described. One slot 327 interconnects one set of three apertures 327*a* and another slot 327 interconnects another set of three apertures 327*a*. It should be appreciated that the base 326 is operatively supported by either the fingerboard 15 or body portion 16.

The primary winding 326 also has a stem portion 326*b* extending generally perpendicular from a central portion of the base 326*a*. The primary winding 326 also includes at least one preferably both slots 327 extending through and along the stem portion 326*b*. The slots 327 are spaced laterally. The primary winding 326 is made from a non-ferrous, conductive material. Preferably, the primary winding 326 is made of a conductive material, such as copper. It should be appreciated that a corner interconnecting the base 326*a* and the stem portion 326*b* can be arcuate. It should also be appreciated that, when the sensor assembly 310 is mounted to the guitar 12 adjacent the fingerboard 15, the stem 326*b* extends into a sound hole 19 of the guitar 12. It should further be appreciated that the primary winding 326 acts as a humbucking primary.

The sensor assembly 310 also includes at least one magnet 328, preferably a plurality of magnets 328, operatively supported by the primary winding 326 to provide a magnetic-flux field to the strings 18. More specifically, the magnets 328 are generally circular in shape and disposed within the apertures 327*a* of the base 326*a* of the primary winding 326. The magnets 328 are of various magnetic strengths and made of a permanent-magnet material such as Neodymium, which is commercially available. It should be appreciated that the magnets 328 may be made of other types of magnetic material, such as ceramic. It should also be appreciated that the magnets 328 and, thus, the apertures 327 can be any suitable size and shape. It should further be appreciated that the there is one magnet 328 for each string 18, which is located below each string 18.

The sensor assembly 310 further includes at least one secondary winding 330, preferably a plurality of secondary windings 330, adjacent the primary winding 326. The secondary windings 330 are generally perpendicular to the stem portion 326*b* such that the secondary windings 330 are generally parallel with both the fingerboard 15 and strings 18. The secondary windings 330 are coils of a conductive wire, such as copper, wrapped around core elements 332,334.

The secondary windings 330 are susceptible to electromagnetic flux transferred by the core elements 332 from the primary winding 326. The secondary windings 330 transform the primary electromagnetic flux into a secondary current. More specifically, the primary winding 326, secondary windings 330, and core elements 332,334 act together as a transformer, which transforms the primary current into the secondary current. The secondary current is passed through an output port (not shown) to electronics subsequent to the sensor assembly 310. It should be appreciated that possible electronic components, which may be operatively connected to the output port, include receivers, synthesizers, amplifiers, speakers, and the like.

The secondary windings 330 are shorter in length than the predetermined length of the primary winding 326. The secondary windings 330 include a first core element 332, which extends through one end of the secondary windings 330, and a second core element 334, which extends through the other end of the secondary windings 330. The first and second core elements 332,334, which are "U" shaped in appearance, extend into the secondary windings 330 from each end and telescopingly engage.

Each of the core elements 332,334 is made from a plurality of, preferably four, laminations of a high permeable-magnetic material, such as steel. The sensor assembly 310 is approximately three millimeters tall and five millimeters wide, and weighs approximately eight grams in a fully shielded humbucker configuration. It should be appreciated that the sensor assembly 310 has a pair of secondary windings 330 that act as dual humbucking secondaries. It should also be appreciated that the secondary windings 330 are disposed within the sound hole 19 from the end of the stem portion 326*b* opposite the base 326*a* and radially away from a center of the sound hole 19. It should further be appreciated that the sensor assembly 310 is humbucking in the primary winding 326 and secondary windings 330 as illustrated by the schematic of FIG. 20.

Figure 22:
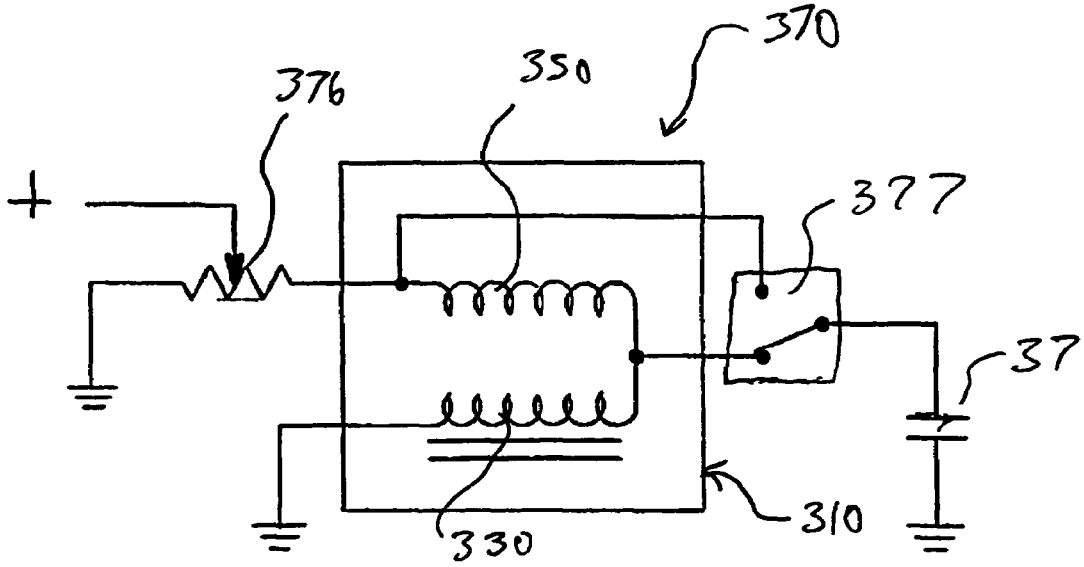
FIG. 22 is a schematic view of the sensor assembly and stringed musical instrument of FIG. 21.
Figure 21:
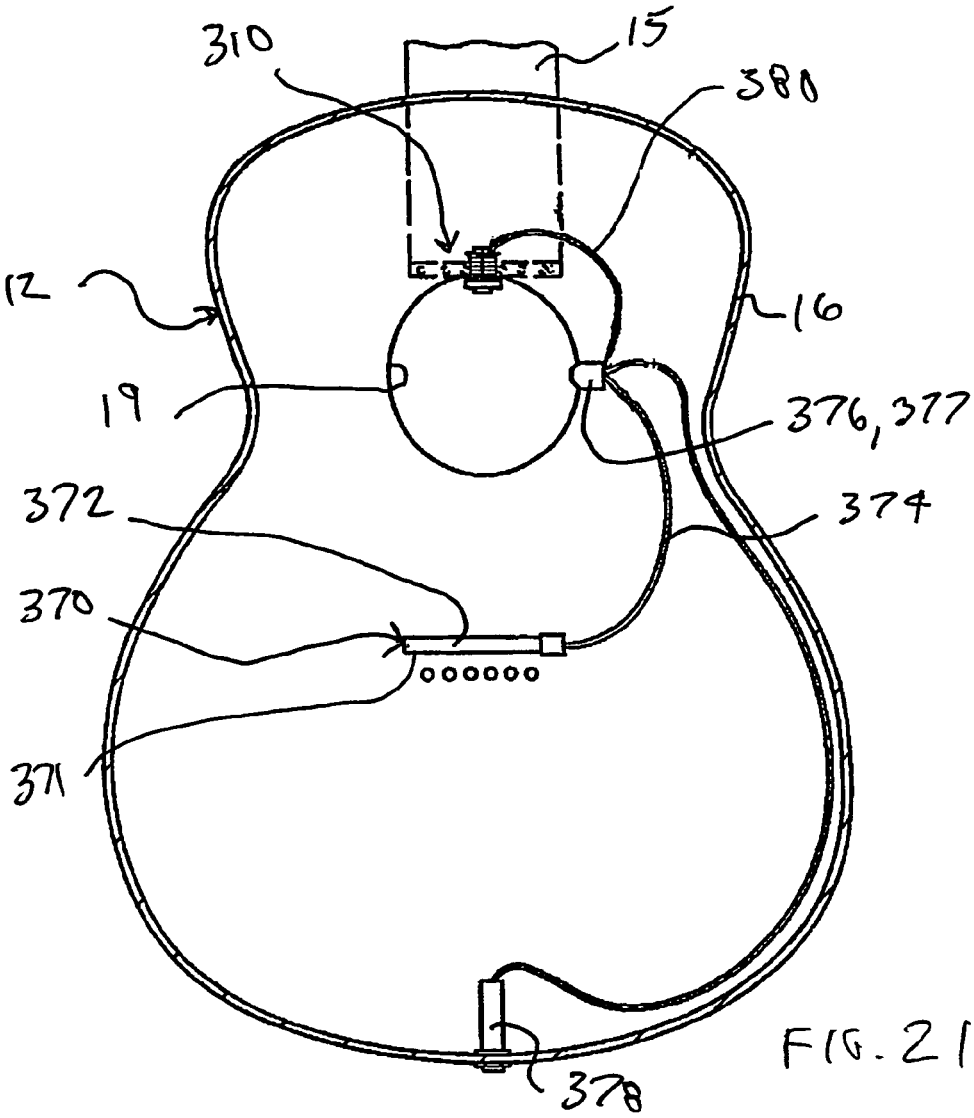
FIG. 21 is a fragmentary elevational view of the sensor assembly and stringed musical instrument of FIG. 18.

Referring to FIGS. 21 and 22, a transducer system, generally indicated at 370, includes the sensor assembly 310 and a bridge pickup or sensor 371. The bridge pickup 371 is supported on the body portion 16 of the guitar 12 on the other side of the sound hole 19 by the body portion 16 opposite the fingerboard 15 of the guitar 12. The bridge pickup 371 is of a piezo type. The bridge pickup 371 is generally rectangular and disposed substantially perpendicular to the body portion 16. It should be appreciated that the bridge pickup 371 is conventional and known in the art.

The transducer system 370 may include a polymer film 372 shielding the bridge pickup 371. The polymer film 372 is made of Kevlar® for dramatically quieter performance. The bridge pickup 371 is operatively connected to the sensor assembly 310 by suitable means such as a wire 374.

The transducer system 370 may include a volume control switch 376 and series/parallel switch 377 located below an edge defining the sound hole 19 and mounted to the body portion 16 by suitable means (not shown). The volume control switch 376 is a potentiometer that is adjustable by a player of the guitar 12 to control the master volume output of the sensor assembly 310 and bridge pickup 371. The series/parallel switch 377 is a three-position micro switch located at a base edge of the sound hole 15 (or under a pickguard on an archtop). The switch 377 is ergonomically located just below the edge of the sound hole 15 and allows the player of the guitar 12 to combine the signal from the bridge pickup 371 either in series or parallel with the secondary windings 330 of the sensor assembly 310 as illustrated in FIG. 22. The volume control switch 376 and series/parallel switch 377 are electrically connected to the sensor assembly 310 and an output jack 378 on the guitar 12 by suitable means such as wires 380. It should be appreciated that the volume control switch 376, series/parallel switch 377, and output jack 378 are conventional and known in the art.

In operation of the transducer system 370, the bridge pickup 371 is of a voltage inducing type and introduces its signal into the secondary windings 330 in between the two humbucking windings 330 so that the signal (voltage) of the bridge pickup 371 combines with the signal (current) of the sensor assembly 310. The bridge pickup 371 can combine its signal either in series or parallel via the series/parallel switch 377 with the secondary windings 330 of the sensor assembly 310.

It should be appreciated that the sensor assembly 310 amplifies the signal from the bridge pickup 371 and combines its detail with that of the warmth of the magnetic sensor assembly 310 to produce a more accurate acoustic tone.

In the transducer system 370, the signals of the bridge pickup 371 combine with the signal of the sensor assembly 310. These signals are mixed and matched by the switch 377, which assigns the two signals in either series, parallel, or true stereo-output modes.

In series mode, the signal from the bridge pickup 371 is inserted directly into the secondary windings 330 on the sensor assembly 310, providing an increase in feedback rejection and volume boost to the mono signal. In parallel mode, the two signals from the sensor assembly 310 and bridge pickup 371 are summed to mono, with the sensor assembly 310 covering most of the bass response and the bridge pickup 371 contributing clarity and attack in the high mids and treble. In the stereo mode, the signal from each of the sensor assembly 310 and bridge pickup 371 comes out independently.

The bridge pickup 371 adds articulation, detail, and dynamics to the mix while the sensor assembly 310 amplifies the signals from the bridge pickup 371 to produce a louder and more passive and accurate acoustic tone or reproduction with high feedback rejection during passive operation. Switching between the series and parallel modes via the switch 377 during performance is like throwing a switch between rhythm- and lead-playing modes.

Figure 23:
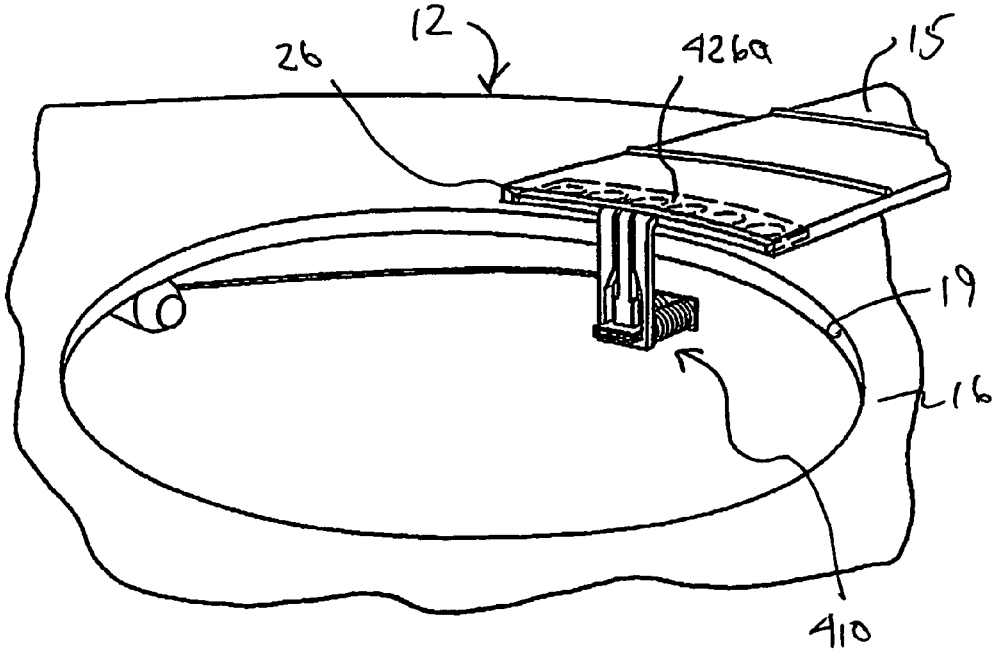
FIG. 23 is a perspective view of a further embodiment, according to the present invention, of the sensor assembly of FIG. 1 illustrated in operational relationship with a portion of a stringed musical instrument.

Referring to FIG. 23, a further embodiment, according to the present invention, of the sensor assembly 10 is shown. Like parts of the sensor assembly 10 have like reference numerals increased by four hundred (400). In this embodiment, the sensor assembly 410 is similar to the sensor assembly 310. The sensor assembly 410 has a base **426*a* of the primary winding 426 disposed below or built into the fingerboard 15 proximate to the body portion 16. The base 426*a* of the sensor assembly 410 can be attached to the fingerboard 15 or body portion 16 by suitable means such as adhesive tape or adjustable screw mounts (not shown). The operation of the sensor assembly 410 is similar to the operation of the sensor assembly 310. It should be appreciated that the base 426*a* of the sensor assembly 410 is submerged below a surface of the fingerboard 15** and is not visible.

Accordingly, the transducer system 370 is completely passive and needs no pre-amp to function properly (except for one channel off-board when used in stereo mode. The transducer system 370 is extremely lightweight with non-invasive installation. The transducer system 370 has the highest feedback threshold commercially available and three-way switching between series, parallel, and stereo modes. The transducer system 370 is nearly invisible including the sensor assembly 310, which does not block the sound hole 15 of the guitar 12. The transducer system 370 is extremely low noise and relative quick and easy to install. The transducer system 370 is available as a package or as separate components, compatible with nearly all amplifiers, PA, and recording equipment.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

a primary winding adapted to be embedded within either one of a fingerboard and a neck of the stringed musical instrument, said primary winding extending laterally to encompass the movable strings; and a plurality of magnets disposed and spaced within the lateral extent of said primary winding and the movable strings to generate a magnetic field, said primary winding creating a primary current from a disruption in the magnetic field by the movable strings, the primary current creating a primary electromagnetic flux; and at least one secondary winding being coupled to said primary winding, said at least one secondary winding transforming the primary electromagnetic flux into a secondary current adapted to pass out the stringed musical instrument.

2. A sensor assembly as set forth in claim 1 wherein said primary winding includes a base.

3. A sensor assembly for a stringed musical instrument having a plurality of movable strings comprising:

a primary winding adapted to be disposed either one of at one end and embedded within either one of a fingerboard and a neck of the stringed musical instrument;

at least one magnet disposed adjacent said primary winding and the movable strings to generate a magnetic field, said primary winding creating a primary current from a disruption in the magnetic field by the movable strings, the primary current creating a primary electromagnetic flux; and at least one secondary winding being coupled to said primary winding, said at least one secondary winding transforming the primary electromagnetic flux into a secondary current adapted to pass out the stringed musical instrument; and wherein said primary winding includes a base extending laterally to encompass the plurality of strings and a stem portion extending from said base and adapted to extend into a sound hole of the stringed musical instrument.

4. A sensor assembly as set forth in claim 3 wherein said stem portion extends generally perpendicular from a central portion of the base.

5. A sensor assembly as set forth in claim 3 wherein said at least one secondary winding is orientated generally perpendicular to said stem portion.

6. A sensor assembly as set forth in claim 1 wherein said primary winding is a closed loop.

7. A sensor assembly as set forth in claim 1 wherein said primary winding is an open loop.

8. A sensor assembly as set forth in claim 1 including a first core element extending through one end of said at least one secondary winding and a second core element extending through the other end of said at least one secondary winding, said first core element and said second core element adapted to receive the electromagnetic flux from said primary winding and transform the electromagnetic flux into the secondary current.

9. A sensor assembly as set forth in claim 8 wherein said first and second core elements are substantially "U" shaped and are adapted to telescopingly engage each other.

10. A sensor assembly for a stringed musical instrument having a plurality of movable strings comprising:

a winding adapted to be disposed either one of within and below a fingerboard of the stringed musical instrument;

at least one magnet disposed adjacent said winding and the movable strings to generate a magnetic field, said winding creating a current from a disruption in the magnetic field by the movable strings, the current creating an electromagnetic flux; and wherein said at least one magnet is generally circular in shape.

11. A sensor assembly for a stringed musical instrument having a plurality of movable strings comprising:

a ferromagnetic blade adapted to be disposed below the strings;

a plurality of magnets disposed adjacent said blade to generate a magnetic field through said blade, said magnets comprising at least one magnet disposed underneath said blade;

a winding adjacent to the magnetic field produced by said magnets to create a current from a disruption in the magnetic field by the movable strings, the current being adapted to be passed out the stringed musical instrument, said winding extending laterally and said at least one magnet being disposed within a lateral extent of said winding.

12. A stringed musical instrument comprising:

a body portion having a sound hole;

a plurality of strings extending over said sound hole;

a single sensor assembly supported on said body portion on one side of said sound hole and comprising at least one magnet disposed below said strings to generate a magnetic field, a primary winding adjacent to the magnetic field produced by said at least one magnet to create a primary current from a disruption in the magnetic field by said strings, the primary current creating a primary electromagnetic flux, and at least one secondary winding being magnetically coupled to said primary winding, said at least one secondary winding transforming the primary electromagnetic flux into a secondary current adapted to be passed out said stringed musical instrument; and a bridge pickup supported on said body portion on the other side of said sound hole and providing a secondary acoustic signal source operating in conjunction with said sensor assembly.

13. A stringed musical instrument as set forth in claim 12 wherein said bridge pickup is of a piezo type.

14. A stringed musical instrument as set forth in claim 12 wherein said bridge pickup is generally rectangular in shape and disposed substantially perpendicular to a body of said stringed musical instrument.

15. A transducer system for a stringed musical instrument having a plurality of strings comprising:

a sensor assembly comprising at least one magnet adapted to be disposed below the strings to generate a magnetic field, a primary winding adjacent to the magnetic field produced by said at least one magnet to create a primary current from a disruption in the magnetic field by the movable strings, the primary current creating a primary electromagnetic flux, and at least one secondary winding being magnetically coupled to said primary winding, said at least one secondary winding transforming the primary electromagnetic flux into a secondary current adapted to be passed out the stringed musical instrument;

a bridge pickup electrically connected to said sensor assembly; and wherein said transducer system includes a polymer film to shield said bridge pickup.

16. A transducer system as set forth in claim 15 wherein said polymer film is made of KEVLAR®.

17. A stringed musical instrument as set forth in claim 12 wherein said transducer system includes a volume control switch being a potentiometer adapted to be adjusted by a player of the stringed musical instrument to control master volume output of said sensor assembly and said bridge pickup.

18. A stringed musical instrument as set forth in claim 17 wherein said transducer system includes a series/parallel switch being of a voltage inducing type and adapted to introduce a signal into said at least one secondary winding so that a signal of said bridge pickup combines with a signal of said sensor assembly, said series/parallel switch adapted to allow the player to combine the signal from said bridge pickup either in series or parallel with said at least one secondary winding.

19. A stringed musical instrument as set forth in claim 18 wherein said series/parallel switch is a three-position micro switch adapted to mix and match the combined signals of said bridge pickup and said sensor assembly.

20. A sensor assembly for a stringed musical instrument having a plurality of movable strings comprising:

at least one blade adapted to be disposed below the movable strings of the stringed musical instrument;

at least one magnet disposed adjacent said at least one blade to generate a magnetic field through said at least one blade; and a winding having a slot to receive said at least one blade to create a current from a disruption in the magnetic field by the movable strings to pass out the stringed musical instrument, said winding extending laterally and said at least one magnet being disposed within a lateral extent of said slot of said winding.

21. A sensor assembly as set forth in claim 20 wherein said at least one blade is a thin plate fabricated from a ferromagnetic material that is susceptible to a magnetic field.

22. A sensor assembly as set forth in claim 20 wherein said winding is a closed loop.

23. A sensor assembly for a stringed musical instrument having a plurality of movable strings comprising:

at least one blade adapted to be disposed below the movable strings of the stringed musical instrument;

at least one magnet disposed adjacent said at least one blade to generate a magnetic field through said at least one blade;

a winding having a slot to receive said at least one blade to create a current from a disruption in the magnetic field by the movable strings to pass out the stringed musical instrument; and wherein said at least one magnet is generally circular in shape.

24. A sensor assembly for a stringed musical instrument having a plurality of movable strings comprising:

a winding adapted to be disposed either one of below and embedded in a fingerboard of the stringed musical instrument, said winding extending laterally to encompass the movable strings;

at least one magnet disposed adjacent said winding and the movable strings to generate a magnetic field, said winding creating a current from a disruption in the magnetic field by the movable strings to be pass out the stringed musical instrument and wherein said at least one magnet is disposed within a lateral extent of said winding.

25. A stringed musical instrument comprising:

a plurality of movable strings;

a fingerboard disposed below said movable strings;

a winding disposed below a said fingerboard;

at least one magnet disposed adjacent said winding and said movable strings to generate a magnetic field, said winding creating a current from a disruption in the magnetic field by said movable strings, the current creating an electromagnetic flux; and wherein said winding extends laterally and has a slot extending through said winding and said at least one magnet is disposed within a lateral extent of said slot of said winding.

* * * * *